United States Patent [19]

Buse et al.

[11] Patent Number: 4,491,846

[45] Date of Patent: Jan. 1, 1985

[54] ARRANGEMENT FOR HOLDING A PLURALITY OF VERTICALLY SUPERIMPOSED ANTENNAS FOR ROTARY ADJUSTMENT

[75] Inventors: Heinrich Buse, Salzgitter; Heinz-Joachim Schmidt, Liebenburg, both of Fed. Rep. of Germany

[73] Assignee: Salzgitter Maschinen und Anlagen Aktiengesellschaft, Salzgitter, Fed. Rep. of Germany

[21] Appl. No.: 348,458

[22] Filed: Feb. 12, 1982

[30] Foreign Application Priority Data

Feb. 25, 1981 [DE] Fed. Rep. of Germany ... 8105223[U]

[51] Int. Cl.[3] ..... H01Q 3/02; H01Q 1/12

[52] U.S. Cl. ..... 343/758; 343/882

[58] Field of Search ..... 343/758, 890, 891, 892, 343/893, 879, 882

[56] References Cited

U.S. PATENT DOCUMENTS

| | | | |
|---|---|---|---|
| 2,981,834 | 4/1961 | Holloway et al. | 343/758 |
| 3,146,452 | 8/1964 | Rose | 343/758 |
| 3,742,358 | 6/1973 | Cesaro | 343/758 |

*Primary Examiner*—Eli Lieberman

*Attorney, Agent, or Firm*—Michael J. Striker

[57] ABSTRACT

An arrangement for holding a plurality of superimposed independently turnable devices on the upper end of a vertical mast, especially antennas on an antenna mast, in which a separate rotary drive is coordinated with each of the devices, in which all the rotary drives are arranged coaxial with the mast and each including a hollow drive shaft and a stationary part, wherein the stationary part of a first rotary drive adjacent the upper end of the mast is releasably connected to one end to the latter and at the other end to a coaxial connecting tube, whereas the drive shaft of this first rotary drive is releasably connected to a tubular carrier turnably and coaxially mounted on the connecting tube and carrying one of the devices, and in which the stationary part of each following rotary drive is releasably connected at one end to the preceding connecting tube and at the other end to a further connecting tube and the drive shaft of each following rotary drive is releasably connected to a tubular carrier turnable and coaxially mounted on the further connecting tube and carrying a further device.

3 Claims, 4 Drawing Figures

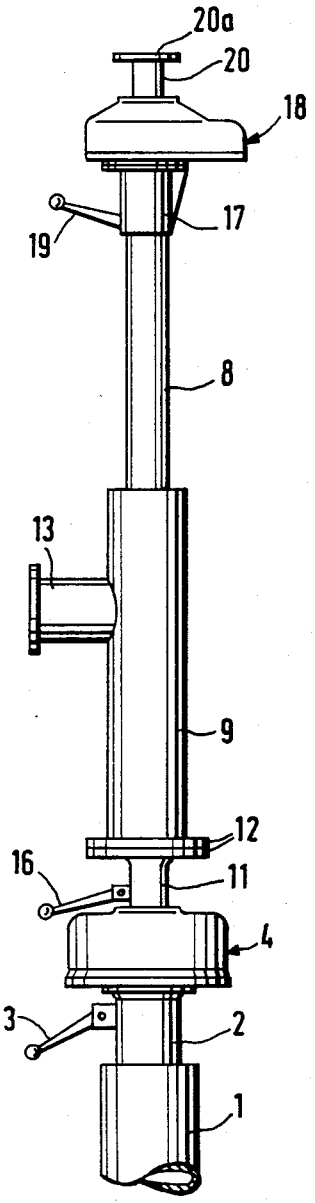
FIG.1
FIG. 2
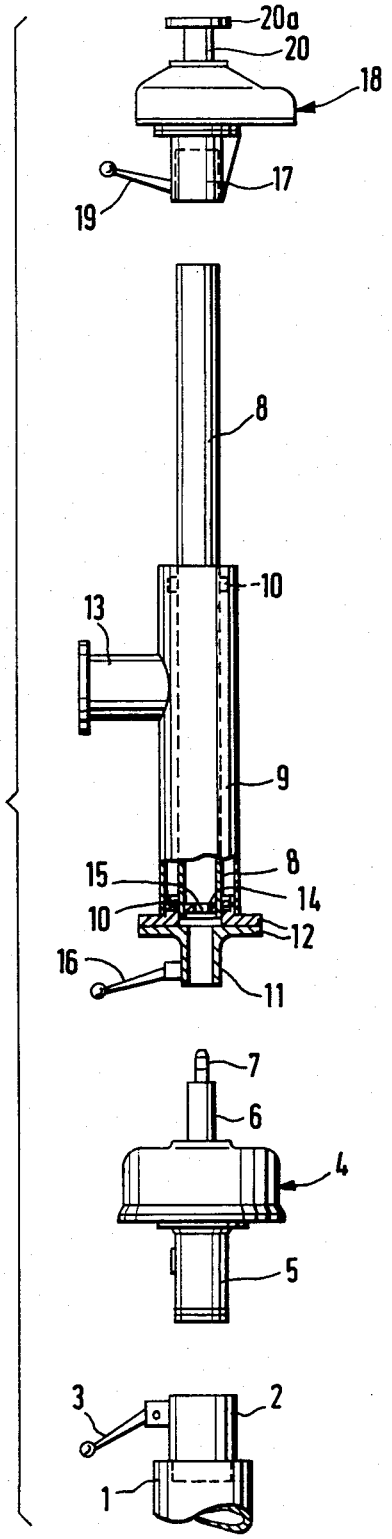

ARRANGEMENT FOR HOLDING A PLURALITY OF VERTICALLY SUPERIMPOSED ANTENNAS FOR ROTARY ADJUSTMENT

BACKGROUND OF THE INVENTION

The present invention relates to an arrangement for holding a plurality of vertically superimposed devices tiltable independently from each other on the upper end of a vertically extending mast, especially antennas on an antenna mast, in which the devices are superimposed upon each other in longitudinal direction of the mast and in which for each of the devices a separate rotary drive is provided.

It is often required, and especially for antennas on a high antenna mast, to hold various devices, respectively the antennas in a safe manner, but at the same time to tilt the devices independently from each other with the aid of a rotary drive, so as to bring the antennas to a respective best orientation. Thereby two problems are of special importance: On the one hand, any asymmetry of the mounting and especially of the arrangement of the individual rotary drives leads at masts at large height to considerable loading of the mast, which is still increased by eventually occurring wind pressure, and on the other hand the complicated mounting of such a holding arrangement causes disadvantages, especially if the antenna mast is mobile, as is often the case. An arrangement of the above-mentioned kind is known in the art (for instance disclosed in a prospectus "Salzgitter Antennenmast W343-677-1000G"), in which the arrangement comprises a carrier tube on which by means of separate platform-like holding elements rotary drives for tilting the antenna carriers are located outside the longitudinal axis of the carrier tube, which respectively act over separate drive elements onto the antenna holders. This known arrangement has therefore the disadvantage of asymmetrically loading the carrier tube and therewith the antenna mast, which especially at high wind pressure is of considerable disadvantage. Furthermore, the mounting of separate drives and holding means on the carrier tube is very time-consuming so that, especially at mobile antenna masts the assembly thereof is considerably increased.

SUMMARY OF THE INVENTION

It is an object of the present invention to provide an arrangement of the above-mentioned kind, which permits a substantially coaxial and therewith symmetrical arrangement of the rotary drives and the essential parts for holding the devices so as to obtain a simple construction and assembly of the whole arrangement on the end of a carrier mast.

This object is obtained according to the present invention in that the various rotary drives are coaxially arranged and in which a stationary part of a first rotary drive at the upper end of the mast is releasably connected at one end to the end of the mast and at its other end with a coaxially arranged connecting tube and in which the drive shaft of the first rotary drive is releasably connected with a hollow carrier shaft turnably mounted on the connecting tube, on which a carrier of a coordinated device is arranged, and that the stationary part of the respective next following rotary drive is releasably connected with the mentioned connecting tube, whereas the drive shaft of this rotary drive is releasably connected with the carrier of the next following device. In this way a coaxial arrangement of the rotary drives as well as the drive elements for the tilting of the devices about a common axis is obtained. This coaxial arrangement of the individual construction elements permits also to assemble and de-assemble the same in a simple manner, since the first rotary drive, the connecting tube with the hollow carrier shaft and the carrier for the device coordinated therewith, as well as the following rotary drives form respectively individual construction units which can be easily handled and easily assembled respectively separated from each other. An asymetrically loading of the arrangement and therewith that of the antenna mast is therewith reduced to a minimum, the assembly is simplified and the assembly time reduced. If the arrangement should include more than two rotary drives for more than two devices, then the above-described arrangement and connection for the first rotary drive can be repeated in the connection to the second rotary drive. Thus, the stationary part of the following rotary drive can be connected to a further connecting tube and the latter then releasably connected with the stationary part of a further following rotary drive, which acts then with its drive shaft onto the carrier of the last device. Thereby the coaxial and releasable arrangement of the individual construction unit is likewise maintained.

According to a further feature of the present invention the releasable connecting means are constructed as coaxial plug-in connections provided with clamping means, whereby the assembly and disassembly of the arrangement is simplified and the necessary erection time reduced. An arrangement which in its construction and for the assembly and disassembly is especially advantageous is obtained according to a further feature of the present invention if the element of the stationary part of the rotary drive which is connected to the connecting tube is constructed as a profiled rod extending through the hollow drive shaft which, by establishing the connection, enters in a complementary profiled recess of the connecting tube, and that the following hollow carrier shaft for the device carrier can be slipped-on with a hollow connecting socket onto the hollow drive shaft, through which the profiled rod extends, and onto which the lower end of the hollow shaft abuts. All necessary, stationary and rotatable connections can in this way be carried out by simple plug-in procedures and clamping. This basic arrangement can be repeated if the arrangement includes more than two devices to be held.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a side view of the arrangement according to the present invention, without showing the devices to be carried thereby;

FIG. 2 is an exploded side view, partly in section of the arrangement shown in FIG. 1;

DESCRIPTION OF A PREFERRED EMBODIMENT

Figure 3:
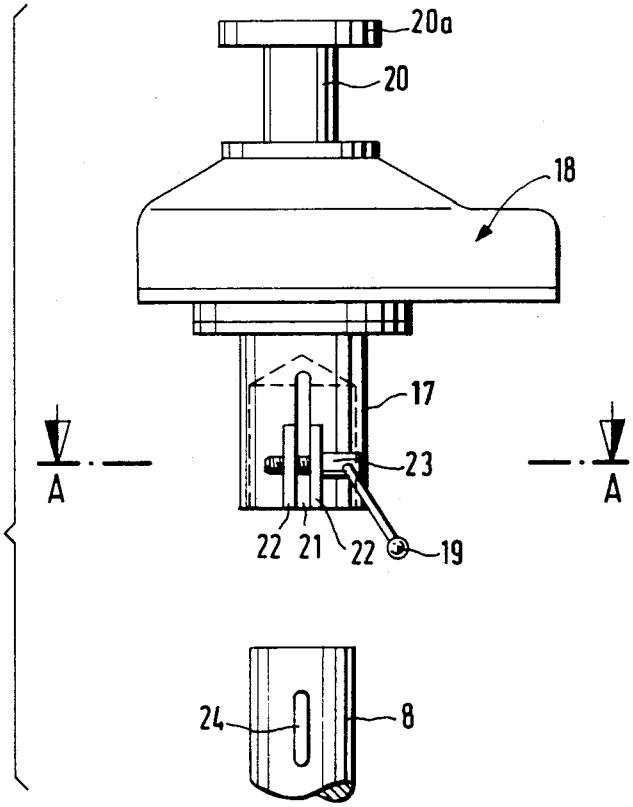
FIG. 3 illustrates the clamping device of a rotary drive means in further detail.

The various Figures of the drawing illustrate the arrangement according to the present invention, which especially serves for holding a plurality of vertically superimposed independently tiltable antennas at the upper end of an antenna mast.

The upper end of an antenna mast 1, only partly shown in FIGS. 1 and 2, is provided with a receiving socket 2 on which a suitable quick-clamping device 3, which will be described later on in further detail, is arranged. This upper end of the mast 1 is followed by a first rotary drive 4 of suitable construction, for instance an electromotor. The rotary drive 4 has a lower stationary part, shown as a stationary connecting stud 5, which can be inserted into the receiving socket 2 and fixedly clamped therein by the quick-clamping device 3. In this way the stationary part of the rotary drive 4, especially the stationary housing of the motor is connected with the upper end of the mast 1. The drive shaft 6 of the rotary drive 4 is constructed as a hollow shaft. A further stationary part of the rotary drive is constructed as a profile rod or bar 7 which extends through the hollow drive shaft 6 and projects with an upper portion beyond the latter. The profile bar 7 retains therefore its position with regard to the mast 1, whereas the hollow drive shaft 6 rotates during actuation of the rotary drive 4. The parts 5, 6 and 7 of the rotary drive 4 are thereby coaxially arranged. Likewise coaxially arranged to the longitudinal axis of the mast 1 is a connecting tube 8 arranged above the first rotary drive 4. A carrier 9 constituted by a tubular shaft is turnably mounted on the connecting tube 8 by means of bearings 10. This tubular carrier shaft 9 is connected at its lower end with a hollow connecting socket 11 by means of a flange connection 12. The connecting tube 8 abuts with its lower end against the connecting socket 11, whereas the upper portion of the connecting tube 8 projects beyond the upper end of the tubular carrier shaft 9. A mounting portion 13 for the respective device, for instance an antenna, projects laterally from the hollow carrier shaft 9. The connecting tube 8 is provided in the region of its lower end with a disc 14 extending transversely thereto which, in turn, is provided with a central opening 15 complementary to the profile of the bar 7. The unit formed by the connecting tube 8 and the tubular carrier shaft 9 with the connecting socket 11 is releasably connected with the first rotary drive 4. For this purpose the connecting socket 11 of the tubular carrier shaft 9 is slipped on the hollow drive shaft 6 of the first rotary drive 4. Thereby the profiled bar 7 enters into the opening 15 of the disc 14 at the lower end of the connecting tube 8. The connecting tube 8 is thereby stationarily connected by the elements 7 and 5 with the upper end of the mast 1, whereas the tubular carrier shaft 9 and therewith a device, for instance an antenna, connected to the mounting portion 13 may be turned about the axis of the mast by means of the first rotary drive 4. For clamping the elements 6 and 11 for simultaneous rotation serves a suitable quick-clamping device 16 provided on the connecting socket 11.

The stationary part 17 of the next-following rotary drive 18 is releasably connected to the upper end of the stationary connecting tube 8. The stationary part 17 of the rotary drive 18 is constructed as a receiving socket which can be slipped onto the upper end of the connecting tube 8 and clamped thereto by a suitable quick-clamping device 19. If, as shown in the drawing only two drives 4 and 18 are provided for, for instance independently turning only two antennas about the axis of the mast 1, then the drive shaft 20 of the second rotary drive 18 is provided at its upper end with a flange **20*a* to which the carrier for the next-following device, for instance a further antenna not shown in the drawing, is connected in any suitable manner. In this way the carrier for the next-following device may be turned about the axis of the mast 1 by means of the rotary drive 18 independent of the rotary movement of the tubular carrier shaft 9 and the mounting portion 13** connected thereto.

If, however, the arrangement according to the present invention should be provided for independently turning more than two devices about the axis of the mast 1, then each rotary drive following in upwards direction the rotary drive 4 has to be constructed to have a downwardly extending connecting socket as shown at 17 for the rotary drive 18 to be slipped over the upper end of a preceding connecting tube 8 and fixedly clampable thereto by a quick-clamping device, whereas the drive shaft thereof has to be constructed as a hollow drive shaft as shown at 6 for the first rotary drive through and beyond of which a profile bar, as shown at 7 for the rotary drive 4 projects. The hollow rotary drive shaft and the stationary bar extending therethrough may then be connected respectively to a following connecting tube and a hollow carrier shaft turnably mounted thereon in the manner as described before. Of course, the last uppermost rotary drive should be constructed as the second rotary drive 18 described above.

Figure 4:
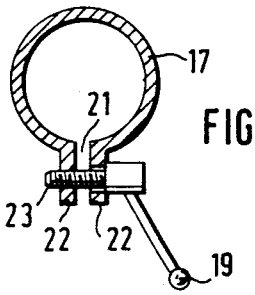
FIG. 4 is a cross section taken along the line A—A of FIG. 3.

FIGS. 3 and 4 show the quick-clamping device of the rotary drive 18 in further detail. As shown in these Figures the stationary, downwardly extending socket 17 of the rotary drive 18 is formed with a slot 21 extending upwardly from the bottom end of the socket. A pair of parallel webs 22 project outwardly from opposite sides of the slot 21. A clamping screw 23 extends with clearance through an opening provided in the right web as viewed in FIG. 4, and through a correspondingly threaded bore in the left web. The clamping screw can be turned by an operating lever 19 connected thereto, so that by turning the screw 23 the slot 21 can be narrowed and thereby the socket 17 be clamped to the upper end of the connecting tube 8.

If it is desired to mount the rotary drive 18 in a certain orientation on the connecting tube 8, then the latter is provided in the region of its upper end with a key 24 which enters from the inside, up to the screw 23 into the slot 21. Of course the width of this key 24 is such so as not to prevent narrowing of the slot.

It is to be understood that the quick-clamping devices 3 and 16, only schematically shown in FIGS. 1 and 2, are constructed in a similar manner as described above.

The rotary drives 4 and 18 as well as the unit comprising the connecting tube 8 and the tubular carrier shaft 9 are arranged coaxially with respect to each other. This substantially coaxial arrangement provides for the above-mentioned advantages. Furthermore, the arrangement according to the present invention permits an especially simple assembly or disassembly of the complete holding arrangement which is obtained by the releasable connections especially by the releasable slip-on connections between the individual units of the arrangement.

It will be understood that each of the elements described above, or two or more together, may also find a useful application in other types of arrangements for holding a plurality of vertically superimposed devices tiltable independently from each other differing from the types described above.

While the invention has been illustrated and described as embodied in an arrangement for holding a plurality of vertically superimposed devices, for instance antennas tiltable independently from each other about the axis of an antenna mast, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In combination with an upright mast, an arrangement for holding a plurality of vertically-spaced devices, especially antennas, on an upper end of the mast and for turning said devices relative to and independent from each other about the axis of the mast, said arrangement comprising a plurality of rotary drive means including a first rotary drive means adjacent the upper end of the mast and an uppermost drive means spaced farthest from said upper end, each of said rotary drive means including a stationary lower part, an upwardly extending hollow drive shaft and, with the exception of said uppermost drive means, also a stationary upper part extending through and projecting with a portion thereof beyond said hollow drive shaft; means for coaxially and releasably connecting said stationary lower part of said first rotary drive means to said upper end of said mast; at least one straight connecting tube and a carrier for a device coaxially mounted on said connecting tube turnable about the axis thereof; further means for coaxially and releasably connecting the hollow drive shaft of said first rotary drive means to a following connecting tube and said stationary upper part of said first drive means to a following carrier turnably mounted on said following connecting tube; and additional means for releasably connecting said stationary lower part of each following drive means to a preceding connecting tube and at least said hollow drive shaft of each following drive means to a carrier for the next following device.

2. An arrangement as defined in claim 1, wherein all of said releasable connecting means are constructed as coaxial plug-in connections provided with clamping means.

3. In combination with an upright mast, an arrangement for holding a plurality of vertically-spaced devices, especially antennas, on an upper end of the mast and for turning said devices relative to and independent from each other about the axis of the mast, said arrangement comprising a plurality of rotary drive means including a first rotary drive means adjacent the upper end of the mast and an uppermost drive means spaced farthest from said upper end, each of said rotary drive means including a stationary lower part, and upwardly extending hollow drive shaft and, with the exception of said uppermost drive means, also a stationary upper part extending through and projecting with a portion thereof beyond said hollow drive shaft; means for coaxially and releasably connecting said stationary lower part of said first rotary drive means to said upper end of said mast; at least one straight connecting tube and a carrier for a device coaxially mounted on said connecting tube turnable about the axis thereof; further means for coaxially and releasably connecting the hollow drive shaft of said first rotary drive means to a following connecting tube and said stationary upper part of said first drive means to a following carrier turnably mounted on said following connecting tube; and additional means for releasably connecting said stationary lower part of each following drive means to a preceding connecting tube and at least said hollow drive shaft of each following drive means to a carrier for the next following device, said upper stationary part of each rotary drive means preceding said uppermost rotary drive means having a non-circular cross section, said further connecting means comprising at a lower end of each connecting tube a coaxial opening of corresponding cross section receiving said upper stationary part of the preceding rotary drive means.

* * * * *